US010486160B2

(12) United States Patent
Young

(10) Patent No.: US 10,486,160 B2
(45) Date of Patent: Nov. 26, 2019

(54) METHOD OF REPLACING HAMMERS AND SPACERS

(71) Applicant: Roger Young, Rock Falls, IL (US)

(72) Inventor: Roger Young, Rock Falls, IL (US)

(73) Assignee: Bliss Industries, LLC, Ponca City, OK (US)

( * ) Notice: Subject to any disclaimer, the term of this patent is extended or adjusted under 35 U.S.C. 154(b) by 0 days.

(21) Appl. No.: 16/266,990

(22) Filed: Feb. 4, 2019

(65) Prior Publication Data

US 2019/0168230 A1 Jun. 6, 2019

Related U.S. Application Data

(63) Continuation-in-part of application No. 16/213,413, filed on Dec. 7, 2018, which is a continuation-in-part (Continued)

(51) Int. Cl.
*B02C 13/00* (2006.01)
*B02C 13/28* (2006.01)

(Continued)

(52) U.S. Cl.
CPC ..... *B02C 13/2804* (2013.01); *B02C 13/04* (2013.01); *B02C 13/06* (2013.01); *B02C 13/16* (2013.01); *B02C 2210/02* (2013.01)

(58) Field of Classification Search
CPC ..... B02C 13/28; B02C 13/04; B02C 13/16; B02C 13/06; B02C 2013/2804; B02C 2013/2808
See application file for complete search history.

(56) References Cited

U.S. PATENT DOCUMENTS 758,288 A 4/1904 Williams
858,772 A 7/1907 Williams (Continued)

FOREIGN PATENT DOCUMENTS

CA 2613956 A1 2/2009
CA 2720159 A1 5/2011

(Continued)

OTHER PUBLICATIONS

Genesis III, Inc., "Hammer Mill Hammers", http://h3hammers.com/hammer-mill-parts/hammer-mill-hammers/#forged, pp. 1-14, accessed on Dec. 7, 2017.

(Continued)

*Primary Examiner* — Faye Francis
(74) *Attorney, Agent, or Firm* — McKee, Voorhees & Sease, PLC

(57) ABSTRACT

Improved free-swinging hammermill hammer configurations are disclosed and described for comminution of materials such as grain and refuse. The hammer configurations of the present disclosure are adaptable to most hammer mill or grinders having free-swinging systems. The configurations as disclosed incorporate comminution edges having increased hardness for longer operational run times. The improved configurations improve installing, removing, and cleaning hammer components within the hammermill. More particularly, a method for replacing hammers and spacers includes pre-assembling hammers, spacers, hammer saddles, locking collars, or any combination thereof and temporarily attaching them to one another before placement onto a hammermill rod. Once placed on the hammermill rod, the temporary attachment is broken such that the hammers within the pre-assembled group may move freely with respect to one another.

8 Claims, 7 Drawing Sheets

Related U.S. Application Data of application No. 15/912,056, filed on Mar. 5, 2018, now Pat. No. 10,207,274.

(60) Provisional application No. 62/595,291, filed on Dec. 6, 2017, provisional application No. 62/579,469, filed on Oct. 31, 2017, provisional application No. 62/548,180, filed on Aug. 21, 2017.

(51) Int. Cl.

| | |
|---|---|
| ***B02C 13/06*** | (2006.01) |
| ***B02C 13/04*** | (2006.01) |
| ***B02C 13/16*** | (2006.01) |

(56) References Cited

U.S. PATENT DOCUMENTS

| | | | |
|---|---|---|---|
| 906,364 | A | 12/1908 | Backus |
| 1,016,979 | A | 2/1912 | Williams |
| 1,041,495 | A | 10/1912 | Liggett et al. |
| 1,085,692 | A | 2/1914 | Liggett |
| 1,266,894 | A | 5/1918 | Williams |
| RE14,865 | E | 5/1920 | Plaisted |
| RE14,920 | E | 7/1920 | Morse et al. |
| 1,433,042 | A | 10/1922 | Sedberry |
| 1,444,990 | A | 2/1923 | Wauthier |
| 1,630,021 | A | 5/1927 | Lucas |
| 1,678,723 | A | 7/1928 | Clement |
| 1,693,058 | A | 11/1928 | Shelton |
| 1,759,905 | A | 5/1930 | Keith |
| 1,760,097 | A | 5/1930 | Williams |
| 1,761,038 | A | 6/1930 | Harley |
| 1,787,526 | A | 1/1931 | Honstain |
| 1,821,912 | A | 9/1931 | Pfeiffer |
| 1,827,986 | A | 10/1931 | Iglehart |
| 1,829,325 | A | 10/1931 | Alfred |
| 1,854,844 | A | 4/1932 | Kaemmerling |
| 1,889,129 | A | 11/1932 | Nielsen |
| 1,911,718 | A | 5/1933 | Saunders |
| 1,927,986 | A | 9/1933 | Levy |
| 1,947,784 | A | 2/1934 | Armstrong |
| 1,954,175 | A | 4/1934 | Jensen |
| 1,997,553 | A | 4/1935 | Taylor, Jr. et al. |
| 2,015,581 | A | 9/1935 | Armour |
| 2,207,455 | A | 7/1940 | Clement |
| 2,237,510 | A | 4/1941 | Tankersley |
| 2,244,577 | A | 6/1941 | Schreiber |
| 2,404,775 | A | 6/1946 | Ehmann |
| 2,404,778 | A | 7/1946 | Allison |
| 2,460,279 | A | 2/1949 | Ehmann |
| 2,531,597 | A | 11/1950 | Anderson |
| 2,566,758 | A | 9/1951 | Anderson |
| 2,566,798 | A | 9/1951 | Hiller |
| 2,602,597 | A | 7/1952 | Ball |
| 2,607,538 | A | 8/1952 | Larson |
| 2,763,439 | A | 9/1956 | Mankoff |
| 3,022,018 | A | 2/1962 | Knight |
| 3,045,934 | A | 7/1962 | Eilers |
| 3,058,676 | A | 10/1962 | Hermann |
| 3,222,854 | A | 12/1965 | Barth |
| 3,278,126 | A | 10/1966 | Ratkowski |
| 3,322,356 | A | 5/1967 | Toews |
| 3,379,383 | A | 4/1968 | Stepanek |
| 3,471,093 | A | 10/1969 | Wienert |
| 3,482,789 | A | 12/1969 | Newell |
| 3,549,095 | A | 12/1970 | Ratkowski |
| 3,598,008 | A | 8/1971 | Jacobson et al. |
| 3,627,212 | A | 12/1971 | Stanton |
| 3,682,401 | A | 8/1972 | Jacobson et al. |
| 3,738,586 | A | 6/1973 | Fabert, Jr. |
| 3,966,126 | A | 6/1976 | Werner |
| 3,966,128 | A | 6/1976 | Anderson et al. |
| 3,979,078 | A | 9/1976 | Boddeker et al. |
| 3,995,816 | A | 12/1976 | Motek |
| 3,997,121 | A | 12/1976 | Motek |
| 4,000,859 | A | 1/1977 | Whitney |
| 4,106,706 | A | 8/1978 | Burrows |
| 4,129,262 | A | 12/1978 | Lowry |
| 4,134,554 | A | 1/1979 | Morlock |
| 4,141,512 | A | 2/1979 | Francis |
| 4,142,687 | A | 3/1979 | Potwin |
| 4,162,767 | A | 7/1979 | Hahn |
| 4,166,583 | A | 9/1979 | Ruckstuhl |
| 4,177,956 | A | 12/1979 | Fawcett |
| 4,202,504 | A | 5/1980 | Cameron |
| 4,310,125 | A | 1/1982 | Novotny |
| 4,313,575 | A | 2/1982 | Stepanek |
| 4,341,353 | A | 7/1982 | Hamilton et al. |
| 4,343,438 | A | 8/1982 | Slikas et al. |
| 4,352,774 | A | 10/1982 | Hornberger |
| 4,406,415 | A | 9/1983 | Greer |
| 4,519,551 | A | 5/1985 | Ceurvorst |
| 4,558,826 | A | 12/1985 | Martinek |
| 4,729,516 | A | 3/1988 | Williams, Jr. |
| 4,795,103 | A | 1/1989 | Lech |
| 4,856,170 | A | 8/1989 | Kachik |
| 4,907,750 | A | 3/1990 | Seifert |
| 4,915,310 | A | 4/1990 | Stelk |
| 5,002,233 | A | 3/1991 | Williams |
| 5,072,888 | A | 12/1991 | Stelk |
| 5,169,077 | A | 12/1992 | Stelk |
| 5,207,391 | A | 5/1993 | Anderson |
| 5,320,292 | A | 6/1994 | Smith |
| 5,364,038 | A | 11/1994 | Prew |
| 5,377,919 | A | 1/1995 | Rogers et al. |
| 5,381,975 | A | 1/1995 | Chon et al. |
| 5,443,216 | A | 8/1995 | Lajoie |
| 5,465,912 | A | 11/1995 | Graybill et al. |
| 5,570,849 | A | 11/1996 | Anderson |
| 5,605,291 | A | 2/1997 | Doskocil |
| 5,611,496 | A | 3/1997 | Fleenor |
| 5,628,467 | A | 5/1997 | Graveman |
| 5,692,688 | A | 12/1997 | Waltman et al. |
| 5,722,607 | A | 3/1998 | Hellmich |
| 5,842,653 | A | 12/1998 | Elliott et al. |
| 5,904,306 | A | 5/1999 | Elliott et al. |
| 5,984,216 | A | 11/1999 | Andela et al. |
| 6,045,072 | A | 4/2000 | Zehr |
| 6,131,838 | A | 10/2000 | Balvanz et al. |
| 6,142,400 | A | 11/2000 | Balvanz et al. |
| 6,260,778 | B1 | 7/2001 | Wenger |
| 6,299,082 | B1 | 10/2001 | Smith |
| 6,364,227 | B1 | 4/2002 | Dorscht |
| 6,394,375 | B1 | 5/2002 | Balvanz et al. |
| 6,394,378 | B1 | 5/2002 | Ragnarsson |
| 6,419,173 | B2 | 7/2002 | Balvanz et al. |
| 6,464,157 | B1 | 10/2002 | Balvanz et al. |
| 6,481,654 | B1 | 11/2002 | Balvanz et al. |
| 6,494,394 | B1 | 12/2002 | Balvanz et al. |
| 6,517,020 | B1 | 2/2003 | Smith |
| 6,520,440 | B2 | 2/2003 | Ragnarsson |
| 6,622,951 | B1 | 9/2003 | Recker et al. |
| 6,971,598 | B2 | 12/2005 | Schillinger et al. |
| 7,140,569 | B2 | 11/2006 | Young |
| D536,350 | S | 2/2007 | Young |
| D536,351 | S | 2/2007 | Young |
| D536,352 | S | 2/2007 | Young |
| D544,503 | S | 6/2007 | Young |
| D544,504 | S | 6/2007 | Young |
| D545,327 | S | 6/2007 | Young |
| D545,328 | S | 6/2007 | Young |
| D545,846 | S | 7/2007 | Young |
| D545,847 | S | 7/2007 | Young |
| D550,728 | S | 9/2007 | Young |
| D551,266 | S | 9/2007 | Young |
| D551,267 | S | 9/2007 | Young |
| D552,638 | S | 10/2007 | Willibald |
| D552,639 | S | 10/2007 | Young |
| D555,679 | S | 11/2007 | Young |
| 7,325,761 | B2 | 2/2008 | Chen et al. |
| D573,163 | S | 7/2008 | Young |
| 7,419,109 | B1 | 9/2008 | Ronfeldt et al. |
| D588,174 | S | 3/2009 | Young |
| 7,559,497 | B2 | 7/2009 | Young |

(56) References Cited

U.S. PATENT DOCUMENTS

| | | | |
|---|---|---|---|
| 7,621,477 | B2 | 11/2009 | Young |
| D616,002 | S | 5/2010 | Willibald |
| 7,819,352 | B2 | 10/2010 | Young |
| D637,633 | S | 5/2011 | Young et al. |
| 8,033,490 | B1 | 10/2011 | Young et al. |
| 8,613,403 | B1 | 12/2013 | Young |
| 8,708,263 | B2 | 4/2014 | Young et al. |
| 8,800,903 | B1 | 8/2014 | Young |
| 8,960,581 | B1 | 2/2015 | Young |
| 8,998,120 | B1 | 4/2015 | Young |
| 9,358,546 | B1 | 6/2016 | Young |
| 9,566,584 | B2 | 2/2017 | Young et al. |
| 2002/0190148 | A1 | 12/2002 | Roozeboom et al. |
| 2004/0017955 | A1 | 1/2004 | Schillinger et al. |
| 2006/0032958 | A1 | 2/2006 | Young |
| 2007/0023554 | A1 | 2/2007 | Young |
| 2009/0321546 | A1 | 12/2009 | Plumb et al. |
| 2010/0025511 | A1 | 2/2010 | Young |
| 2010/0090047 | A1 | 4/2010 | Wilibald |
| 2010/0213301 | A1 | 8/2010 | Hoice et al. |
| 2011/0042498 | A1 | 2/2011 | Young et al. |
| 2016/0243554 | A1 | 8/2016 | Young |

FOREIGN PATENT DOCUMENTS

| | | | |
|---|---|---|---|
| DE | 10215833 | A1 | 11/2003 |
| EP | 1444990 | A1 | 8/2004 |

OTHER PUBLICATIONS

Rightway Manufacturing, "Hammers", http://www.rwmfginc.com/products.aspx?gs=1, pp. 1-3. Oct. 19, 2017.

Watson, Stanley A. & Paul E. Ramstad, eds. (Corn: Chemistry and Technology, American Association of Cereal Chemist, Inc., St. Paul, Minn.), Chapter 11—Alexander, Richard J., "Corn Dry Milling: Processes, Products, and Applications", pp. 351-376. 1987.

Postalloy® Tungsten Carbide Hardfacing Products, "Tungsten Carbide Hardfacing", http://tungstencarbidehardfacing.com/tungstencarbidehardfacing/index_tchf.php, pp. 1-4. Nov. 12, 2017.

"MIG Welding: The Basics for Mild Steel", http://www.millerwelds.com/resources/article-library/mig-welding-the-basics-for-mild-steel, pp. 1-9. Nov. 12, 2017.

"Jacobs Pentagon XTREME Hammer System", https://www.jacobscorp.com/t-pentagon.aspx, accessby by Applicant in 2018.

METHOD OF REPLACING HAMMERS AND SPACERS

CROSS REFERENCE TO RELATED APPLICATIONS

This is a continuation-in-part application which claims priority under 35 U.S.C. § 120 to U.S. Ser. No. 16/213,413, filed Dec. 7, 2018. U.S. Ser. No. 16/213,413 is a continuation-in-part application of U.S. Ser. No. 15/912,056, filed Mar. 5, 2018, which claims priority to provisional patent applications U.S. Ser. No. 62/595,291, filed Dec. 6, 2017, U.S. Ser. No. 62/579,469, filed Oct. 31, 2017, and U.S. Ser. No. 62/548,180, filed Aug. 21, 2017. These applications are herein incorporated by reference in their entirety, including without limitation, the specification, claims, and abstract, as well as any figures, tables, appendices, or drawings thereof.

FIELD OF THE INVENTION

The present invention relates generally to non-forged rotary hammermill hammers.

BACKGROUND OF THE INVENTION

U.S. Pat. Nos. 7,140,569 and 7,621,477, which are both incorporated by reference in their entirety herein and are both to Young, note several industries rely on impact grinders or hammermills to reduce materials to a smaller size. For example, hammermills are often used to process forestry, agricultural products, and minerals and to recycle materials. Materials processed by hammermills include grains, animal food, pet food, food ingredients, mulch, and bark.

Whole grain corn must be cracked before further processing and may be cracked after tempering yet before conditioning. Particle size reduction may be accomplished with a hammermill including successive rows of rotating hammer like devices spinning on a common rotor next to one another comminute the grain product. Several methods for size reduction as applied to grain and animal products are described in Watson, S. A. & P. E. Ramstad, ed. (1987, Corn: Chemistry and Technology, Chapter 11, American Association of Cereal Chemist, Inc., St. Paul, Minn.), the disclosure of which is hereby incorporated by reference in its entirety.

Hammermills may also be generally referred to as crushers and typically include a steel housing or chamber containing a plurality of hammers mounted on a rotor and a suitable drive train for rotating the rotor. As the rotor turns, the correspondingly rotating hammers come into engagement with the material to be comminuted or reduced in size. Hammermills typically use screens formed into and circumscribing a portion of the interior surface of the housing. The size of the particulate material is controlled by the size of the screen apertures against which the rotating hammers force the material. Exemplary embodiments of hammermills are disclosed in U.S. Pat. Nos. 5,904,306; 5,842,653; 5,377,919; and 3,627,212, which are all incorporated herein.

Swinging hammers with blunt edges are typically better suited for processing "dirty" products, or products containing metal or stone contamination. The rotatable hammers of a hammermill may recoil backwardly if the hammer cannot break or push the material on impact. Even though a hammermill is designed to better handle the entry of a "dirty" products, there still exists a possibility for catastrophic failure of a hammer causing severe damage to the hammermill and requiring immediate maintenance and repairs.

Treatment methods such as adding weld material to the end of the hammer blade improve the comminution properties of the hammer. These methods typically infuse the hammer edge, through welding, with a metallic material resistant to abrasion or wear such as tungsten carbide. See for example U.S. Pat. No. 6,419,173, incorporated herein by reference, describing methods of attaining hardened hammer tips or edges as are well known in the prior art by those practiced in the arts.

Hammers are typically singular units and are not rigidly secured together. For example, as is shown in FIGS. 1-4 of U.S. Pat. No. 7,140,569, the hammers may be slid onto a drive shaft and spacers are placed in between each hammer. This configuration presents many potential gaps, all of which are exposed to debris, thereby creating excessive or premature wear. It is therefore desirable to minimize the number of parts and the corresponding number of gaps to extend the life of the hammer assembly.

The use of separate hammers and spacers also presents removal and installation difficulties. While some parts may be keyed to the drive shaft, flying debris can dent or damage parts thereby making removal or installation difficult. The increased number of parts also complicates the assembly/disassembly process. Thus, there is a need in the art to simplify the installation and replacement process and to minimize the number of parts being replaced.

The four metrics of strength, capacity, run time, and the amount of force delivered are typically considered by users of hammermill hammers to evaluate any hammer to be installed in a hammermill. A hammer to be installed is first evaluated on its strength. Typically, hammermill machines employing hammers of this type are operated twenty-four hours a day, seven days a week. This punishing environment requires strong and resilient material that will not prematurely or unexpectedly deteriorate. Next, the hammer is evaluated for capacity, or more specifically, how the weight of the hammer affects the capacity of the hammermill. The heavier the hammer, the fewer hammers that may be used in the hammermill by the available horsepower. A lighter hammer increases the number of hammers that may be mounted within the hammermill for the same available horsepower. More force delivered by the hammer to the material to be comminuted against the screen increases effective comminution (e.g. cracking or breaking down of the material) and efficiency of the comminution process. The force delivered is evaluated with respect to the weight of the hammer. Finally, the longer the hammer lasts, the longer the machine is able to run, resulting in larger profits presented by continuous processing of the material in the hammermill through reduced maintenance costs and lower necessary capital inputs. The four metrics are interrelated and typically tradeoffs are necessary to improve performance. For example, to increase the amount of force delivered, the weight of the hammer could be increased. However, because the weight of the hammer increased, the capacity of the unit typically will be decreased because of horsepower limitations. There is a need in the art to improve upon the design of hammermill hammers available in the prior art for optimization of the four (4) metrics listed above.

BRIEF SUMMARY OF THE INVENTION

Therefore, it is a primary object, feature, or advantage of the present invention to improve on or overcome the deficiencies in the art.

It is still yet a further object, feature, or advantage of the present invention to provide a saddle or a hammer mouth which accommodates a hammer body or multiple hammer bodies and eliminates the need for spacers.

It is still yet a further object, feature, or advantage of the present invention to provide an apparatus that may be used in a wide variety of applications.

It is still yet a further object, feature, or advantage of the present invention to improve the securement end of free-swinging hammers for use in hammer mills.

It is still yet a further object, feature, or advantage of the present invention to provide a hammer that is easily installed and removed.

It is still yet a further object, feature, or advantage of the present invention to improve the durability and operational runtime of hammermill hammers.

It is still yet a further object, feature, or advantage of the present invention to provide hammers having hardened edges by such means as welding or heat treating.

It is still yet a further object, feature, or advantage of the present invention to provide a hammer allowing for improved projection of momentum to the hammer blade tip to thereby increase the delivery of force to comminution materials.

It is still yet a further object, feature, or advantage of the present invention to provide a cost-effective hammer.

It is still yet a further object, feature, or advantage of the present invention to provide an aesthetically pleasing hammer.

It is still yet a further object, feature, or advantage of the present invention to provide hammers that improve the safety of the operator of a hammermill.

It is still yet a further object, feature, or advantage of the present invention to incorporate hammer into a hammermill accomplishing some or all of the previously stated objectives.

It is still yet a further object, feature, or advantage of the present invention to provide methods of using, manufacturing, installing, repairing the hammer or hammermill accomplishing some or all of the previously stated objectives.

The following provides a list of aspects or embodiments disclosed herein and does not limit the overall disclosure. It is contemplated that any of the embodiments disclosed herein can be combined with other embodiments, either in full or partially, as would be understood from reading the disclosure.

According to some aspects of the present disclosure, a method of installing hammers onto a hammermill rod comprises arranging at least two hammers into a group, securing adjacent members of the group to one another with a temporary attachment, placing the group onto the hammermill rod, and removing or breaking the temporary attachment such that the hammers within the group may move freely with respect to one another.

According to some additional aspects of the present disclosure, the temporary attachment is a brittle weld.

According to some additional aspects of the present disclosure, the brittle weld comprises boron nitride.

According to some additional aspects of the present disclosure, the temporary attachment is a brittle adhesive.

According to some additional aspects of the present disclosure, the brittle adhesive is a glue.

According to some additional aspects of the present disclosure, the group further comprises a spacer.

According to some additional aspects of the present disclosure, the group further comprises a hammer saddle.

According to some additional aspects of the present disclosure, the method further comprising transporting the group using an assembly rod before placing the group onto the hammermill rod.

According to some additional aspects of the present disclosure, several groups are transported using the assembly rod before placing the group onto the hammermill rod.

According to some additional aspects of the present disclosure, the at least two hammers have distinct configurations.

According to some additional aspects of the present disclosure, the group spans approximately 3.5 inches.

According to some additional aspects of the present disclosure, the removing or breaking of the temporary attachment is accomplished by hitting the temporary attachment with a blunt object.

According to some other aspects of the present disclosure, an assembly for a hammermill comprises a group of hammers, each hammer in the group of hammers comprising a front surface, a rear surface opposite the front surface, a first end, a second end for contact and delivery of momentum to material to be comminuted, wherein said second end has a weld hardened edge, and a rod hole for securing the hammer to a hammermill rod of the rotatable hammermill assembly. A temporary attachment operatively secures at least one hammer in the group of hammers to at least one other hammer in the group of hammers.

According to some additional aspects of the present disclosure, the temporary attachment is a brittle weld.

According to some additional aspects of the present disclosure, the temporary attachment is a brittle adhesive.

According to some additional aspects of the present disclosure, the assembly further comprises a spacer within the group of hammers.

According to some additional aspects of the present disclosure, the assembly further comprises a locking collar within the group of hammers.

According to some additional aspects of the present disclosure, the weld hardened edge of each hammer is welded to the periphery of the second end and comprises two side contact edges opposite one another, a top contact edge, and tungsten carbide for increased hardness.

According to some additional aspects of the present disclosure, the two side contact edges are stepped.

According to some additional aspects of the present disclosure, the hammer is symmetrical across the front surface such that either of the side contact edges may be the leading edge during operation of the rotatable hammermill assembly.

These or other objects, features, and advantages of the present invention will be apparent to those skilled in the art after reviewing the following detailed description of the illustrated embodiments, accompanied by the attached drawings.

Figure 1:
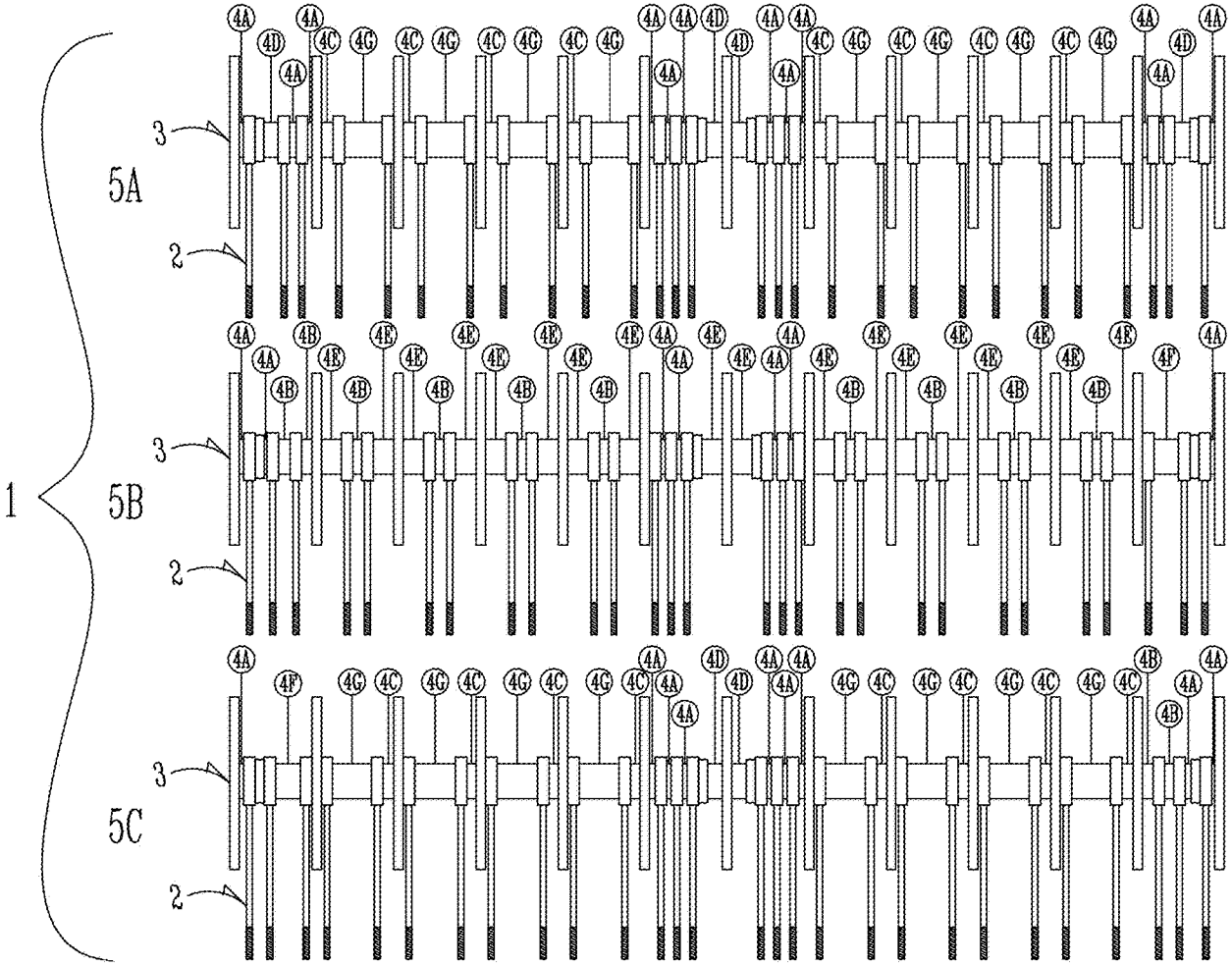
Fig. 1 (Prior Art)
FIG. 1 provides a schematic for an exemplary hammermill layout known in the art, the hammermill layout using hammers with hammer saddles and spacers.

Various embodiments of the present disclosure illustrate several ways in which the present invention may be practiced. These embodiments will be described in detail with reference to the drawings, wherein like reference numerals represent like parts throughout the several views. Reference to specific embodiments does not limit the scope of the present disclosure and the drawings represented herein are presented for exemplary purposes.

DETAILED DESCRIPTION

The following definitions and introductory matters are provided to facilitate an understanding of the present invention. Unless defined otherwise, all technical and scientific terms used herein have the same meaning as commonly understood by one of ordinary skill in the art to which embodiments of the present invention pertain.

The terms "a," "an," and "the" include plural referents unless context clearly indicates otherwise. Similarly, the word "or" is intended to include "and" unless context clearly indicate otherwise. The word "or" means any one member of a particular list and also includes any combination of members of that list.

The terms "invention" or "present invention" as used herein are not intended to refer to any single embodiment of the particular invention but encompass all possible embodiments as described in the specification and the claims.

The terms "about" and "substantially" as used herein refer to variation in the numerical quantities that can occur, for example, through typical measuring techniques and equipment, with respect to any quantifiable variable, including, but not limited to, mass, volume, time, distance, wave length, frequency, voltage, current, and electromagnetic field. Further, given solid and liquid handling procedures used in the real world, there is certain inadvertent error and variation that is likely through differences in the manufacture, source, or purity of the ingredients used to make the compositions or carry out the methods and the like. The claims include equivalents to the quantities whether or not modified by the term "about" or "substantially."

The term "configured" describes an apparatus, system, or other structure that is constructed to perform or capable of performing a particular task or to adopt a particular configuration. The term "configured" can be used interchangeably with other similar phrases such as constructed, arranged, adapted, manufactured, and the like.

Terms such as first, second, vertical, horizontal, top, bottom, upper, lower, front, rear, end, sides, concave, convex, and the like, are referenced according to the views presented. These terms are used only for purposes of description and are not limiting unless these terms are expressly included in the claims. Orientation of an object or a combination of objects may change without departing from the scope of the invention.

The apparatuses, systems, and methods of the present invention may comprise, consist essentially of, or consist of the components of the present invention described herein. The term "consisting essentially of" means that the apparatuses, systems, and methods may include additional components or steps, but only if the additional components or steps do not materially alter the basic and novel characteristics of the claimed apparatuses, systems, and methods.

The following embodiments are described in sufficient detail to enable those skilled in the art to practice the invention however other embodiments may be utilized. Mechanical, procedural, and other changes may be made without departing from the spirit and scope of the invention. Accordingly, the scope of the invention is defined only by the appended claims, along with the full scope of equivalents to which such claims are entitled.

FIG. 1 shows a schematic for an exemplary hammermill layout 5 known in the art for a known hammermill 1, the hammermill layout 5 utilizing hammers with saddles 2, a hammermill rod 3, spacers 4A-4G. The spacers 4A-4G are relied on primarily to eliminate slack and movement among the known hammers with saddles 2 while maintaining an optimized distance between consecutive hammers. However, these spacers are expensive, and a single set of spacers 4A-4G can cost an owner of a hammermill over $900 for a single hammermill.

In the example shown, the spacers 4A-4G have increasing thicknesses (e.g., 4G is thicker than 4F which is thicker than 4E, etc.). As can be seen from FIG. 1, a known hammermill rod 3 may include spacers arranged in one of three exemplary patterns, in order to optimize comminuting of a material put into the known hammermill 1:

First Exemplary Row: 4A, 4D, 4A, 4A, 4C, 4G, 4C, 4G, 4C, 4G, 4C, 4G, 4A, 4A, 4A, 4D, 4D, 4A, 4A, 4A, 4C, 4G, 4C, 4G, 4C, 4G, 4C, 4G, 4A, 4A, 4D, 4A;

Second Exemplary Row: 4A, 4A, 4B, 4B, 4E, 4B, 4E, 4E, 4B, 4E, 4E, 4B, 4E, 4E, 4B, 4E, 4A, 4A, 4E, 4E, 4A, 4A, 4E, 4B, 4E, 4E, 4B, 4E, 4E, 4B, 4E, 4E, 4B, 4E, 4F, 4A;

Third Exemplary Row: 4A, 4F, 4G, 4C, 4G, 4C, 4G, 4C, 4G, 4C, 4A, 4A, 4A, 4D, 4D, 4A, 4A, 4A, 4G, 4C, 4G, 4C, 4G, 4C, 4G, 4C, 4B, 4B, 4A, 4A.

Figure 2:
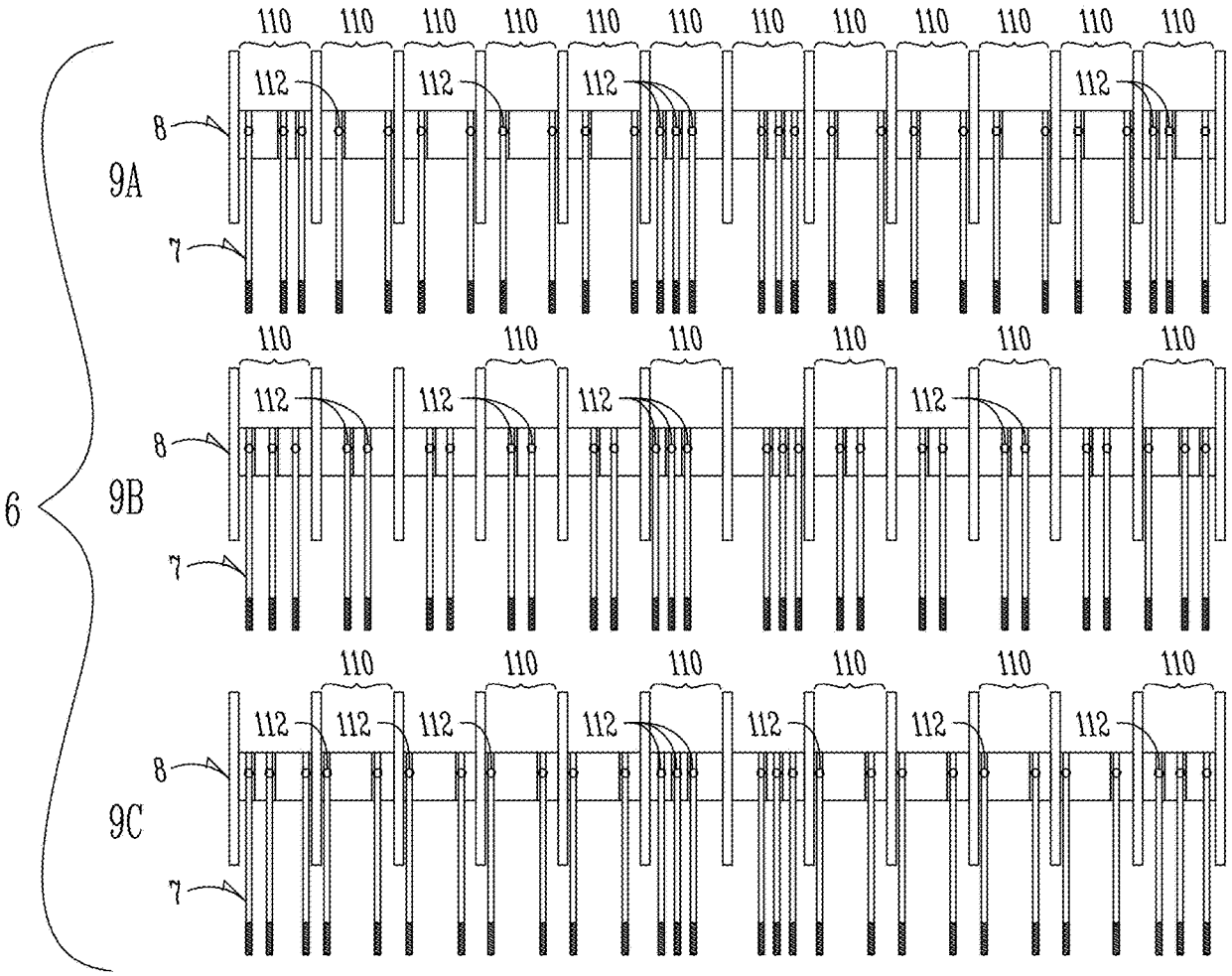
FIG. 2 provides a schematic for an improved hammermill layout which shows the use of temporary attachments securing pre-installed groups of hammers to one another as they are initially placed onto a hammermill rod.
Figure 3:
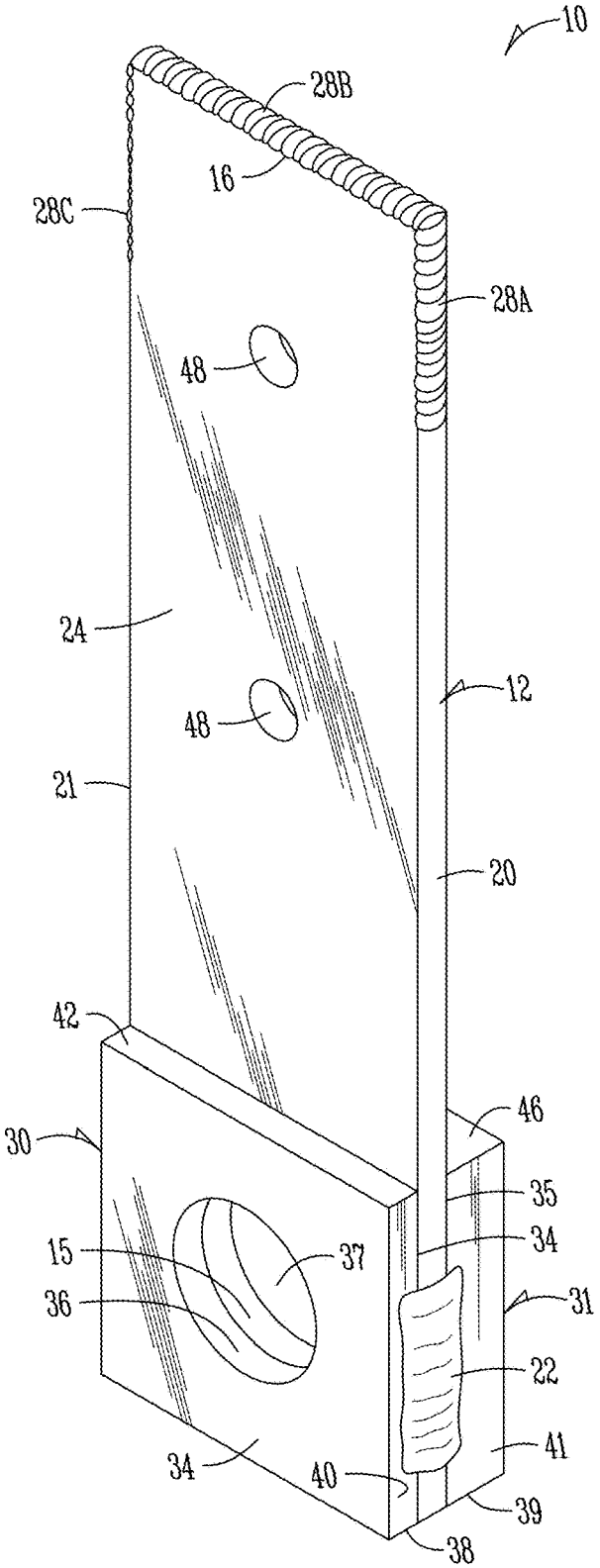
FIG. 3 provides a perspective view of an improved hammer.
Figure 4:
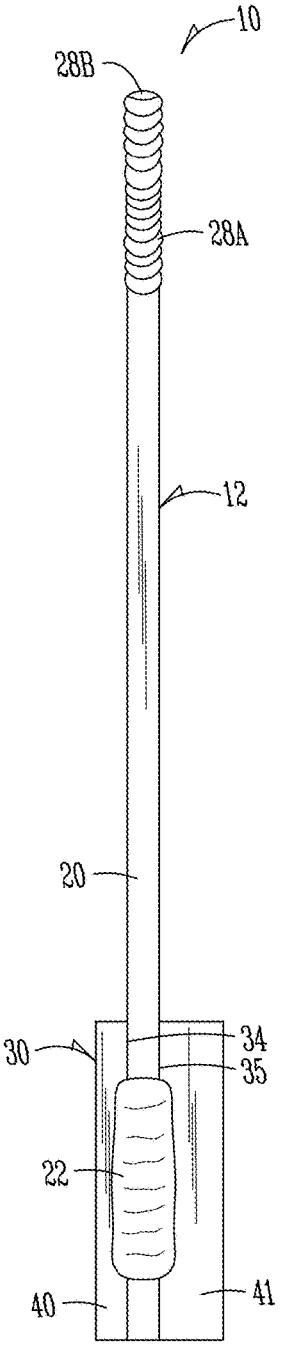
FIG. 4 provides an edge view of the hammer of FIG. 3.
Figure 5:
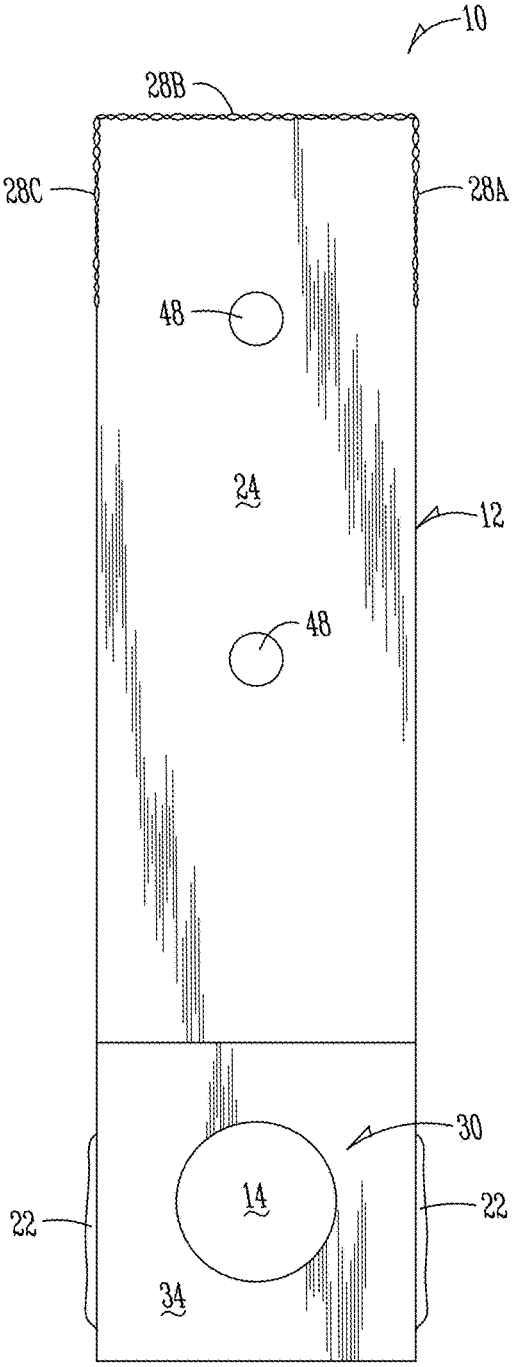
FIG. 5 provides a side view of the hammer of FIG. 3.
Figure 6:
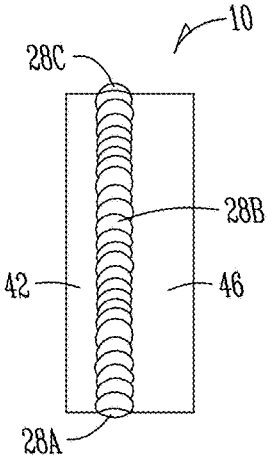
FIG. 6 provides a top view of the hammer of FIG. 3.

FIG. 2 shows a schematic for an improved hammermill layout 9 for an improved hammermill 6 which can eliminate the need for the use of spacers because the hammer "saddles" essentially incorporate the spacer directly into the hammer/saddle 7 and reduce the number of parts required to be installed on the hammermill rod 8. Similar patterns may be created to those discussed above depending on the varied thicknesses of the plates which make up the hammers/saddles 7.

To further facilitate and simplify the installation process, several of the hammers, saddles, spacers (such as those seen in FIG. 1), locking collars (such as those seen in FIG. 1), or some combination thereof may be grouped into a pre-installed hammer group or pocket 110 before being assembled onto the hammermill rod. The pre-installed hammer group 110 is temporarily grouped together until the pre-installed hammer group 110 is placed onto the hammermill rod. The pre-installed hammer group 110 may be secured to one another with temporary attachments 112 as is exemplified in FIG. 2. The temporary attachments 112 may comprise a brittle weld such as a boron nitride weld or a brittle adhesive such as a glue to secure the hammers, saddles, spacers, locking collars, or some combination thereof to one another during transportation and assembly of the pre-installed hammer group 110. During transportation the pre-installed hammer group 110 may be placed onto an assembly rod (e.g., a cardboard or paper assembly tube, a plastic or metal pipe, or any suitable substantially cylindrical object, etc.) having a similar diameter to the hammermill rod the pre-installed hammer group 110 will eventually be installed on. The temporary attachment 112 is eventually easily broken (e.g., by tapping them with a blunt object) after the pre-installed hammer group 110 is eventually placed onto the hammermill rod. This allows the individual hammers within the hammer group to move freely with respect to one another.

The exemplary improved hammers 10 shown in FIGS. 3-10 increase the surface area available to support the hammer 10 relative to the thickness of the hammer body 12. Increasing the surface area available to support the hammer body 12 while improving securement also increases the amount of material available to absorb or distribute operational stresses while still allowing the benefits of the free-swinging hammer design, e.g., recoil to non-destructible foreign objects. The configuration also greatly reduces lateral movement of the hammer 10 and can be made wide enough to eliminate it completely. The hammer body 12, the front plate 30, or the rear plate 31 can be made wider to reduce lateral movement.

The hammer body hammer body 12, the front plate 30, or the rear plate 31 allow the three-piece hammer 10 to be heat treated so that the hammer body 12 is as hard as needed to reduce hole wear and acts more like spring steel (e.g., taking some impact without breaking). However, it should be appreciated a similar concept could still work using a single piece integrally formed by the hammer body 12, front plate 30, and the rear plate 31, however this could complicate the process associated with manufacturing such a piece. If hammer body 12 is heat treated, the timing of the heat treatment with respect to when hammer body 12 is integrated into hammer 10. This configuration allows for a denser hammer pattern and hammers thinner than the industrial standard of ¼" thick. However, in some situations, the hammer body 12 may not need to be heat treated to achieve the desired level of hardness.

Because it is preferred that variable hammer 10 be at least three separate pieces, including one plate on each side of planar hammer body 12, an operator of the hammermill can still easily replace worn or broken hammers without having to disassemble the hammermill rod from the hammermill assembly. This installation process allows an installer to complete the installation process in approximately or less than one hour, whereas previous methods of installing the hammers took approximately eight hours. A typical hammermill will wear through nine or eighteen sets of hammers a month, and so this significantly increases the time in which the hammermill may be operated, and significantly decreases costs associated with the installation process, as less labor is required.

The width of the mounting portion of hammer 10 has been increased by the front plate 30 and the rear plate 31, thus allowing for a thinner hammer body 12. Increasing the surface area available to support the hammer 10 improves securement and increases the amount of material available to absorb or distribute operational stresses while still allowing the benefits of the free-swinging hammer design, e.g., recoil to non-destructible foreign objects. Additionally, the amount of material surface supporting attachment of hammer 10 to a hammermill rod (not shown) is dramatically increased. This has the added benefit of eliminating or reducing the wear or grooving of the hammermill rod (not shown).

Further benefits of the improved hammer 10 include the prevention of hammer 10 "figure eighting" during hammermill operation.

FIGS. 3-10 show exemplary improved, (preferably non-forged) planar hammers 10 to be installed in a hammermill assembly similar to that of the improved hammermill configuration 9. Planar hammer 10 includes planar hammer body 12.

Hammer body distal end 16 has contact edges 28A-C that comminute and grind grains, animal food, pet food, food ingredients, mulch, bark, etc. during operation of the hammermill assembly. In the embodiment shown, hammer body 12 is symmetrical across hammer body front surface 24 and hammer body rear surface 25 such that either of the side contact edges 28A, 28C may be the leading edge during operation of the hammermill assembly. The side contact edge 28A/28C serving as the leading edge will wear much faster than the trailing side contact edge 28A/28C. Changing which side contact edge is the leading edge may be accomplished by reversing the direction of rotation of the hammermill assembly or may be accomplished by re-installing the planar hammer 10 in the mirrored orientation. The width of the contacting edges 28A-C is substantially equivalent to the width of distal end 16 of the hammer body 12. It may be preferred that contact edges 28A-C have been welded onto distal end 16 using tungsten carbide to increase hardness and durability of the planar hammer 10, as is shown in FIGS. 3-9. It may also be preferred that side contact edges 28A, 28C be stepped, as is shown in FIG. 10. Other types of welding materials known to those skilled in the art may also be applied.

The hammer body proximate end 18 is used to secure planar hammer 10 to the front plate 30 and the rear plate 31 at the end where planar hammer body 12 attaches to the hammermill rod 8 of a hammermill assembly 9. Planar hammer body 12, the front plate 30, and the rear plate 31 are welded together where hammer body first side edge 20 meets front plate side surfaces 40 and rear plate side surfaces 41. Welds 22 may span the entire width of the side of the hammer 10 or may be less than the total. Welds 22 are preferably fusion type welds, but the present disclosure also contemplates utilizing solid-state welding methods or other types of welding methods known to those skilled in the art. The present disclosure is also not limited to the use of welds to secure the planar hammers 10 to the front plate 30 and the rear plate 31. For example, the planar hammers 10 could be secured to the front plate 30 and the rear plate 31 via rivets or any other known means for fastening non-forged steel together.

The front plate 30 and the rear plate 31 generally include front surfaces 32, 33, rear surfaces 34, 35, internal rod hole edges 36, 37 bottom surfaces 38, 39, a pair of side surfaces 40, 41, and top surfaces 42, 46. As is substantially shown, the front and rear plates 30, 31 are plates with a rectangular perimeter with circular holes bored through the center of the plates. However, the present disclosure contemplates any known shape may be used for the perimeter, including a circular shape, elliptical shape, buckle shape, triangular shape, or any other known shape. The side surfaces 40, 41 extend from the bottom surfaces 38, 39 at the proximate end 18 of planar hammer body 12 to the top surfaces 42, 46. It is preferable that the hammer body bottom surface 26 is flush with the front plate bottom surface 38 and the rear plate bottom surface 39 such that each of the surfaces is substantially within the same plane, however the present disclosure is not to be limited to such a configuration. The front plate 30 and the rear plate 31 are secured or otherwise operatively attached to the hammer body front surface at the proximate end 18. In a preferred embodiment, the front plate 30 is of a thickness that is different than the thickness of the rear plate 31 and the front plate 30 and the rear plate 31 are not integrally formed with the hammer body front surface 24 or the hammer body rear surface 25.

Planar hammer body 12 has a hammermill rod hole 14 and a hammermill rod hole edge 15 near its proximate end 18. In the embodiment shown, hammermill rod hole edge 15 and front plate and rear plate rod hole edges 36, 37 create a continuous surface for hammermill rod engagement. Planar hammer body 12, the front plate 30, and the rear plate 31 may be welded together before attachment to a hammermill rod when the hammermill 6 is dis-assembled.

Additionally, FIGS. 3-6 show planar hammer body 12 including hammer body holes 48 to allow for a lighter blade. Hammer body holes 48 may be elliptical (including circular), partially elliptical (including oval shaped and semi-circular), conical, or polygonal in nature, be shaped to form any other known shapes, or shaped using a combination of any of the preceding shapes.

Figure 7:
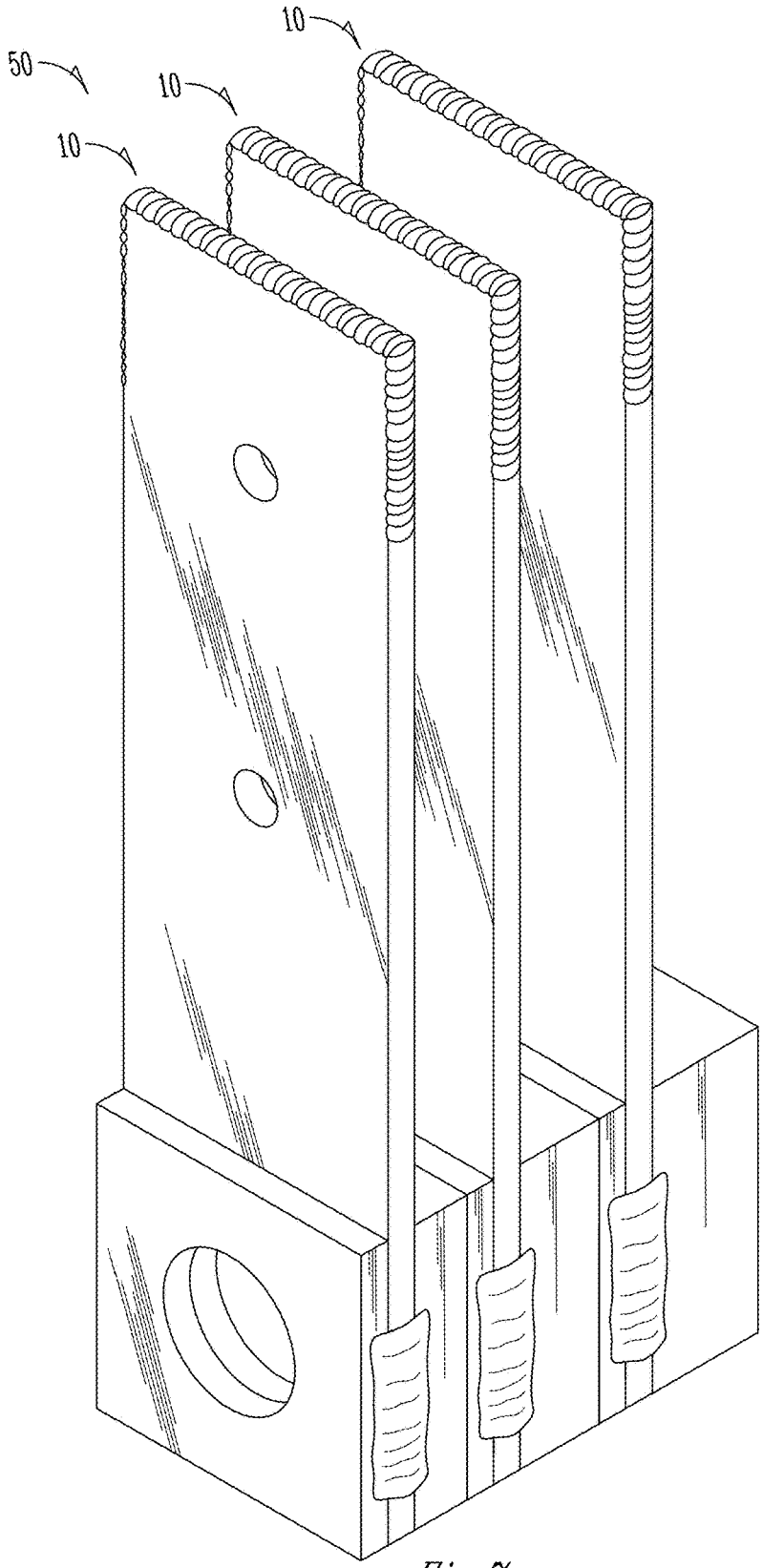
FIG. 7 provides a perspective view of a hammer assembly that implements several hammers of FIG. 3.
Figure 8:
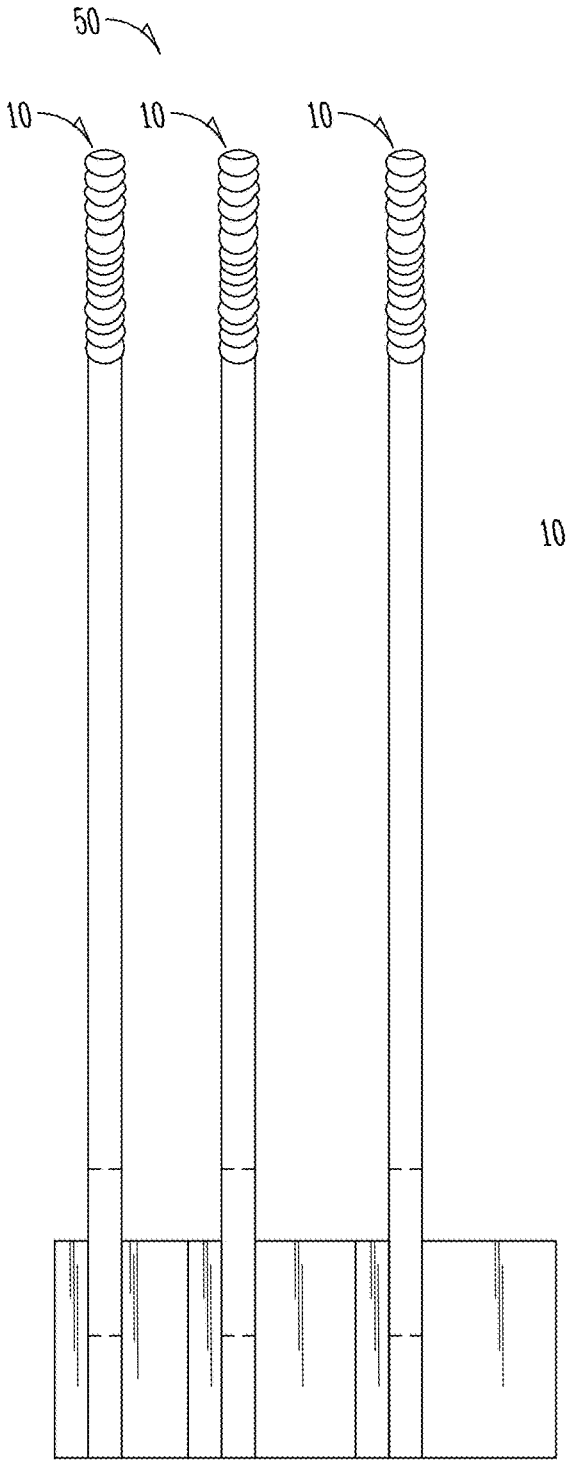
FIG. 8 provides a side view of the improved hammer assembly of FIG. 7.
Figure 9:
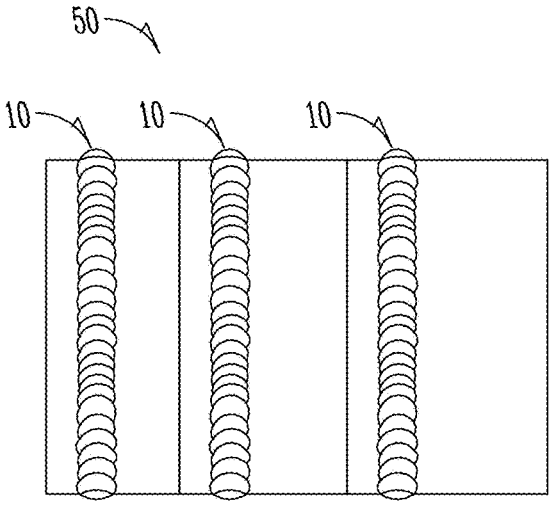
FIG. 9 provides a top view of the improved hammer assembly of FIG. 7.
Figure 10:
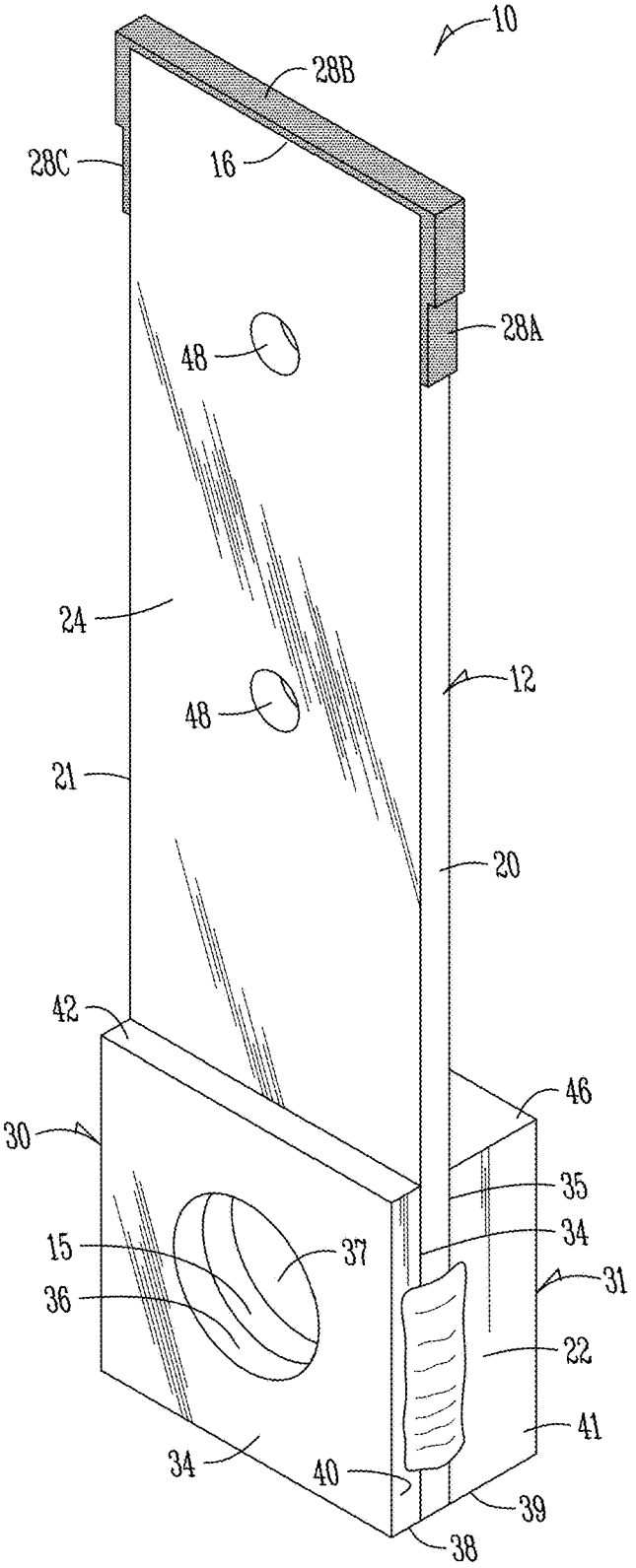
FIG. 10 provides a perspective view of an alternative improved hammer.

FIGS. 7-9 show an improved, non-forged hammer assembly 50 to be installed in a hammermill assembly 9 using planar hammers 10 from the embodiment shown in FIGS. 3-6. The proximate ends 18 of the planar hammer bodies 12 are now used to secure the planar hammers 10 to one another.

The present disclosure is not limited to the use of a circular rod hole. For example, the hammermill rod hole 14 may be tear drop shaped, polygonal, or any other known shape which allows the hammer bodies 12 to attach to a hammermill rod 8, as is shown in the parent application (U.S. Ser. No. 15/912,056) to the present application. In fact, the use of non-circular shapes for the hammermill rod hole 14 may facilitate cleaning of the hammermill rod hole 14 while the hammer 10 is still attached to the hammermill rod 8.

A method of installing the hammers 10 or hammer assemblies 50 on a hammermill rod of a hammermill is contemplated by the present disclosure. More particularly, the installation process may include acquiring a hammermill having several support members, a hammermill rod, and several different hammers 10 in accordance with the aspects of the present disclosure described above. The hammermill rod can then be fed through apertures within each of the support members of the hammermill or otherwise secured to the support members of the hammermill. As the hammermill rod is being fed through the apertures of each of the support members, the hammers 10 may be placed onto the hammermill rod such that they are snugly arranged (e.g. the hammers 10 are adjacent to and contact front plates 30, rear plates 32, other hammers 10, or support members of the hammermill) according to a desired pattern. Using the improved hammers 10 eliminates the need for spacers and locking collars, however some spacers or locking collars may still be used.

From the foregoing, it can be seen that the present invention accomplishes at least all of the stated objectives.

LIST OF REFERENCE NUMERALS

The following list of reference numerals is provided to facilitate an understanding and examination of the present disclosure and is not exhaustive. Provided it is possible to do so, elements identified by a numeral may be replaced or used in combination with any elements identified by a separate numeral. Additionally, numerals are not limited to the descriptors provided herein and include equivalent structures and other objects possessing the same function.

1 known hammermill
2 known hammers with saddles
3 known hammermill rod
4A-4G known spacers
5A-5C known hammermill row configuration
6 improved hammermill
7 improved hammers with saddles
8 improved hammermill rod
9A-9C improved hammermill row configuration
10 hammer
12 hammer body
14 hammermill rod hole
15 hammermill rod hole edge of the hammer body
16 hammer body distal end
18 hammer body proximate end
20 hammer body first side edge
21 hammer body second side edge
22 fusion weld
24 hammer body front surface
25 hammer body rear surface
26 hammer body bottom surface
28A first side contact edge
28B top contact edge
28C second side contact edge
30 front plate
31 rear plate
32 front plate front surface
33 rear plate front surface
34 front plate rear surface
35 rear plate rear surface
36 front plate rod hole edge
37 rear plate rod hole edge
38 front plate bottom surface
39 rear plate bottom surface
40 front plate side surfaces
41 rear plate side surfaces
42 front plate top surface
46 rear plate top surface
48 hammer body hole
50 hammer assembly
110 pre-installed hammer group or pocket
112 temporary attachment (e.g., boron nitride weld)

The present disclosure is not to be limited to the particular embodiments described herein. The following claims set forth a number of the embodiments of the present disclosure with greater particularity.

What is claimed is:

1. An assembly for a hammermill, the assembly comprising:
- a group of hammers, each hammer in the group of hammers comprising:
  - a front surface;
  - a rear surface opposite the front surface;
  - a first end;
  - a second end for contact and delivery of momentum to material to be comminuted, wherein said second end has a weld hardened edge; and
  - a rod hole for securing the hammer to a hammermill rod of the rotatable hammermill assembly; and
- a temporary breakable attachment operatively securing at least one hammer in the group of hammers to at least one other hammer in the group of hammers.

2. The assembly of claim 1 wherein the temporary breakable attachment is a brittle weld.

3. The assembly of claim 1 wherein the temporary breakable attachment is a brittle adhesive.

4. The assembly of claim 1 further comprising a spacer within the group of hammers.

5. The assembly of claim 1 further comprising a locking collar within the group of hammers.

6. The assembly of claim 4 wherein the weld hardened edge of each hammer is welded to the periphery of the second end and comprises:

two side contact edges opposite one another;

a top contact edge; and tungsten carbide for increased hardness.

7. The assembly of claim 6 wherein the two side contact edges are stepped.

8. The assembly of claim 6 wherein each hammer is symmetrical across the front surface such that either of the side contact edges may be the leading edge during operation of the rotatable hammermill assembly.

* * * * *